US011768468B2

(12) United States Patent
Merdanovic et al.

(10) Patent No.: US 11,768,468 B2
(45) Date of Patent: Sep. 26, 2023

(54) STRIKING MECHANISM, WATCH AND REGULATOR

(71) Applicant: Bucherer AG, Lucerne (CH)

(72) Inventors: Samir Merdanovic, Arch (CH); Markus Kaiser, Root (CH)

(73) Assignee: BUCHERER AG, Lucerne (CH)

( * ) Notice: Subject to any disclaimer, the term of this patent is extended or adjusted under 35 U.S.C. 154(b) by 507 days.

(21) Appl. No.: 17/101,168

(22) Filed: Nov. 23, 2020

(65) Prior Publication Data

US 2021/0165370 A1 Jun. 3, 2021

(30) Foreign Application Priority Data

Dec. 2, 2019 (CH) ..... 01522/19

(51) Int. Cl.
*G04B 21/06* (2006.01)
*G04B 31/012* (2006.01)

(52) U.S. Cl.
CPC ..... *G04B 21/06* (2013.01); *G04B 31/0123* (2013.01)

(58) Field of Classification Search
CPC ..... G04B 21/06; G04B 31/00; G04B 31/06; G04B 31/012; G04B 31/0123
See application file for complete search history.

(56) References Cited

U.S. PATENT DOCUMENTS

2007/0079657 A1* 4/2007 Moteki ..... G04B 21/06 73/535
2008/0008052 A1* 1/2008 Moteki ..... G04B 21/08 368/260
2019/0196409 A1* 6/2019 Bifrare ..... G04B 21/14
2019/0196410 A1* 6/2019 Bifrare ..... G04B 21/12
2019/0204785 A1* 7/2019 Bifrare ..... G04B 11/006

FOREIGN PATENT DOCUMENTS

CH 14179 10/1897

OTHER PUBLICATIONS

Switzerland Search Report dated May 12, 2020, Application No. 15222019, 3 pages.

* cited by examiner

*Primary Examiner* — Edwin A. Leon
*Assistant Examiner* — Jason M Collins
(74) *Attorney, Agent, or Firm* — Rankin, Hill & Clark LLP

(57) ABSTRACT

A regulator for a striking mechanism of a mechanical watch including a base, which can be assembled in a fixed manner with regard to the housing and which rotatably mounts a rotary wheel. At least two mass elements are arranged on the rotary wheel and by way of a rotation of the rotary wheel are deflectable radially outwards counter to a spring force on account of the centrifugal force, in order to regulate the rotation speed of the rotary wheel. At least three bearing elements are attached to the base, the bearing elements engaging peripherally on the rotary wheel, in order to mount this relative to the base.

16 Claims, 4 Drawing Sheets

STRIKING MECHANISM, WATCH AND REGULATOR

BACKGROUND OF THE INVENTION

Description of the Invention

The invention relates to the field of watches, in particular wristwatches, with a mechanical movement. In particular, the present invention relates to movements with a striking mechanism, in particular with a repetition striking mechanism (repeater), for example a minute repetition, as well as to a regulator for such a striking mechanism.

Description of Related Art

Repeaters are complications for mechanical watches, which permit the acoustic representation of time at a point in time which can be selected by the user. Minute repetitions with regard to which hours, quarter hours and minutes are successively struck on in total two different gongs are particularly popular. The energy which is required for the striking is supplied by way of pressure upon an activating lever, is stored in a barrel and is released again during the striking.

Repeaters and other striking mechanisms require a regulator, by way of which the speed of the bell strike is controlled and hence a uniform sound is also ensured. Known regulators include a rotary wheel, which is provided with mass elements, which, given a rotation, are deflected outwards counter to a spring force on account of the centrifugal force. Such a regulator is described in the Swiss patent 334, with regard to which the mass elements are deflected so far until they come into contact with a stationary inner wall. The rotation movement is limited on account of the arising friction, whereupon the mass elements are retracted inwards again due to the spring force. The rotation speed subsequently increases again due to the lack of friction. A pendulating movement can result, wherein the rotation speed always pendulates about a speed value that is defined by the spring constants and at which the centrifugal force is just about sufficient in order to deflect the mass elements counter to the spring force to such an extent that they contact the inner wall.

It has already also been suggested in the case of such a regulator with mass elements to use a braking mechanism other than by way of frictional force, for example the generation of eddy currents in the surrounding element. It has likewise already been suggested to regulate the speed in this manner, without the mass elements having to rub on the inner wall, by way of an equilibrium resulting between, on the one hand, the torque that is produced by the drive, and, on the other hand, the torque that is necessary for overcoming the inertia, which is increased given a deflection of the mass elements to the outside.

The rotary wheel, which is necessary for the regulator, is mounted on an axis, which includes a mounting at the upper side and the lower side. This has the disadvantage that the regulator takes up relatively much space.

SUMMARY OF THE INVENTION

It is the object of the present invention to provide a striking mechanism, a watch as well as a regulator that overcome the disadvantages of the state of the art and that permit a compact construction manner.

A striking mechanism for a mechanical watch includes a striking device, a drive and a regulator. According to an aspect of the invention, the regulator includes a base, which can be assembled in a manner fixed with regard to the housing and which rotatably mounts a rotary wheel. At least two mass elements are arranged on the rotary wheel and are deflectable radially outwards counter to a spring force by way of a rotation or the rotary wheel on account of the centrifugal force, in order to regulate the rotation speed of the rotary wheel. At least three bearing elements, for example ball bearings, are attached on the base and engage on the rotary wheel in a peripheral manner, in particular radially from the outside, in order to mount this relative to the base.

In contrast to the state of the art, the rotary wheel is therefore not mounted by a shaft that is attached concentrically to the rotation axis and that, for its part, is mounted by a mounting with a ball bearing below and above the rotary wheel, but along the periphery of the rotary wheel. By way of this, the axial dimension of the regulator—thus its depth—can be reduced compared to the state of the art. As a whole a much flatter design is possible.

In particular therefore, the regulator is free of a shaft or the like, the shaft lying on the rotation axis of the rotary wheel and mounting this. The rotary wheel requires no shaft.

The bearing elements are not movable relative to the base, for example in the circumferential direction, but are each rotatable about a rotation axis, by which means the rotary wheel on its rotation rolls on the bearing elements. The bearing elements can be, for example, ball bearing elements (i.e. include a ball bearing, for example by way of them forming a ball bearing). Such include, for example, an inner element the is mounted in a fixed manner with regard to the housing (for example, an inner ring), an outer ring and a plurality of balls between the inner element and the outer ring, by which means the outer ring can rotate relative to the inner element with a low resistance.

The base of the regulator can include a ring-like portion that defines a rotationally cylindrical inner surface, within which the rotary wheel rotates. Given a high rotation speed, the mass elements at the radial outer side contact this inner surface, which is fixed with regard to the housing. By way of the deflection of the mass elements outwards and the subsequently increasing moment of inertia as well as possibly by way of the friction that arises on contact, the rotation movement of the rotary wheel is braked, whereupon the mass elements are retracted inwards by way of the spring force. As a result of this, the rotation movement is accelerated once again until the mass elements are again deflected outwards and can contact the inner surface, etc. In this manner, the rotation speed is regulated such that it oscillates about an equilibrium state (for example: the mass elements only just contact the inner surface) or possibly assumes this state given a sufficiently large damping.

In particular, precisely three bearing elements can be present, these bearing elements are arranged or distributed in the circumferential direction, for example, in a uniform manner.

The presence of more than three bearing elements is also not to be ruled out. Four, five or even more bearing elements can be used.

The bearing elements can be attached to the base such that their radial position can be set. This permits a fine adjustment, for example in order to achieve an optimal, play-free and silent as possible rotation behaviour. The settability of the radial position can be ensured, for example, by way of a bearing pin including a first bearing portion that is fixed with respect to the housing and a second bearing portion that is arranged eccentrically with respect to the first bearing portion. The position of the second bearing portion perpendicular to the axis of the first bearing portion can, hence, be set by way of rotating the bearing pin.

Apart from ball bearings, other bearing elements can also be considered, for example rollers that, for their part, are mounted by plain bearings, or the bearing elements themselves can be designed as plain bearings, for example as jewel bearings. As a further alternative, the bearing elements can also be designed as balls or rollers that are guided in a corresponding groove of the housing or of a base, so that the rotary wheel as a complete part can be considered as a ring (inner or possibly outer ring) of a ball bearing. The only thing that is important is that a mounting is possible from the periphery and that the friction losses are not too large.

The rotary wheel forms a peripheral, radially outer or possibly inner running surface, on which the bearing elements engage. For a smooth rolling of the bearing elements, the running surface can be designed such that it has no structure in the circumferential direction but is smooth, i.e., it is constant as a function of the azimuth angle and in particular includes no toothing or the like.

The running surface, however, can form a circumferential groove or possibly circumferential tongue, which interacts with a complementary structure of the bearing elements in order to fix the rotary wheel in the axial direction. The complementary structure of the bearing elements, however, in their design and dimensioning can differ from the structure of the running surface such that generally only two contact points per bearing element are formed. This can be effected, for example, by way of the respective groove in the region of the contact with the element (ring; spring), which engages into it having no or a smaller curvature than the respective surface of the engaging element. In an example, the bearing wheel includes an outer circumferential groove, which is roughly V-shaped, and the outer rings (rollers) of the bearing elements are shaped convexly in a cross section perpendicular to the rotation axis, so that two contact points result.

The mass elements in particular are attached to the rotary wheel such that they are each pivotable outwards about a pivot axis. In particular, they can be coupled to one another, and specifically such that they can only be deflected together, i.e., a deflection of the one mass element effects a deflection of the other mass element about the same angle. Such a coupling can be effected, for example, via a restoring gearwheel, which is toothed with the mass elements, and such a restoring gearwheel in particular can be arranged centrically on the rotary wheel and be arranged in a manner rotatable to this.

A solution with mass elements that are coupled onto one another has the advantage that a single common spring is sufficient in order to effect the restoring force. One does not need to use two springs, and in particular two springs do not need to be matched to one another in a very precise manner in order to prevent imbalance.

The spring can be a spiral spring. The common spring, supplementarily or alternatively can possibly engage on the restoring gearwheel.

Apart from the regulator, the present invention also relates to a striking mechanism, in particular to a repeater, for example, a minute repetition, with the regulator. The repeater includes a mechanical control, which enquires the time at the mechanical movement and effects a sequence of strikes of one or more hammers upon one or more gongs, the sequence being dependent on the enquired time. The frequency of hammer strikes is herein controlled by the regulator.

The invention also relates to a watch, in particular a wristwatch, with such a striking mechanism.

BRIEF DESCRIPTION OF THE DRAWINGS

The subsequent drawings represent exemplary embodiments of the invention, by way of which the invention is described in detail. In the drawings, the same reference numerals denote the same or analogous elements. The drawings show.

DETAILED DESCRIPTION OF THE INVENTION

The manner of functioning and the implementation of the invention are hereinafter shown by way of different exemplary embodiment examples. It is to be understood that the invention is not limited to these embodiments but also includes other embodiments which are in conformity with the claims.

Figure 1:
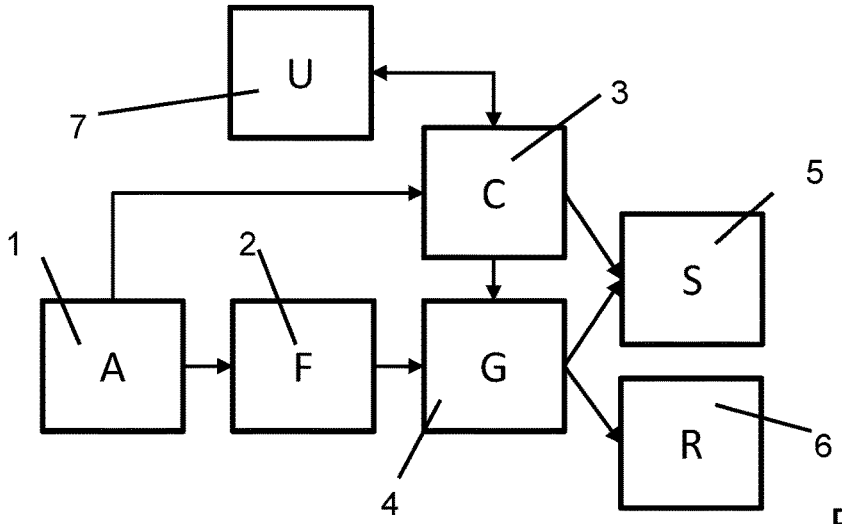
FIG. 1 a schematic diagram of the building blocks of a striking mechanism.

FIG. 1 in a very schematic manner shows the building blocks for a striking mechanism, specifically here for a repeater. The actuation of an actuation element 1, for example a lever, on the one hand has the effect that a mechanical energy store 2, for example a barrel with a spiral spring is charged. On the other hand, it has the effect that a mechanical control 3 permits the energy, which is stored in the energy store, via a gear (wheel mechanism) 4 to be released in a targeted manner, on the one hand to a striking mechanism 5—for example with a hammer or several hammers, which strikes/strike upon one or more different sound elements, for example gongs—and, on the other hand, to a regulator 6. The control operates such that it enquires the current time from a movement 7 of the watch and effects a certain sequence of strikes in the striking mechanism 5 in a manner dependent on this time.

Traditional striking mechanisms differ from repetition striking mechanisms in that the activation is not effected via an actuation element, but automatically by the movement at predefined times. It can also be different by way of the mechanical control not having to enquire the time, but itself including a coding of the sequence of strike sequences.

Mechanical controls and striking mechanics for striking mechanisms, which can be quite complex, are known per se. Many variants of such striking mechanisms are described in literature. The advantages of the present invention do not depend on the construction of the mechanical control 3 and likewise not on the construction of the actuation element 1 or other wind-up mechanism, of the mechanical energy store 2, of the gear 4 or of the striking mechanism 5. For these reasons, the subsequent description of embodiments of the invention is restricted to the description of the construction and manner of functioning of the regulator.

The function of the regulator 6—and this applies to repeaters as well as other striking mechanisms—is to regulate the speed of the striking sequence in a manner such that it is approximately independent of the state of the energy store, thus, for example, of the tension of the spiral spring. This is effected by way of a speed-dependent resistance being brought to oppose a drive of a moved element of the regulator—in the present example of the rotary wheel. The movement of the moved element of the regulator on the one hand and of the striking mechanism on the other hand are coupled to one another.

Figure 2:
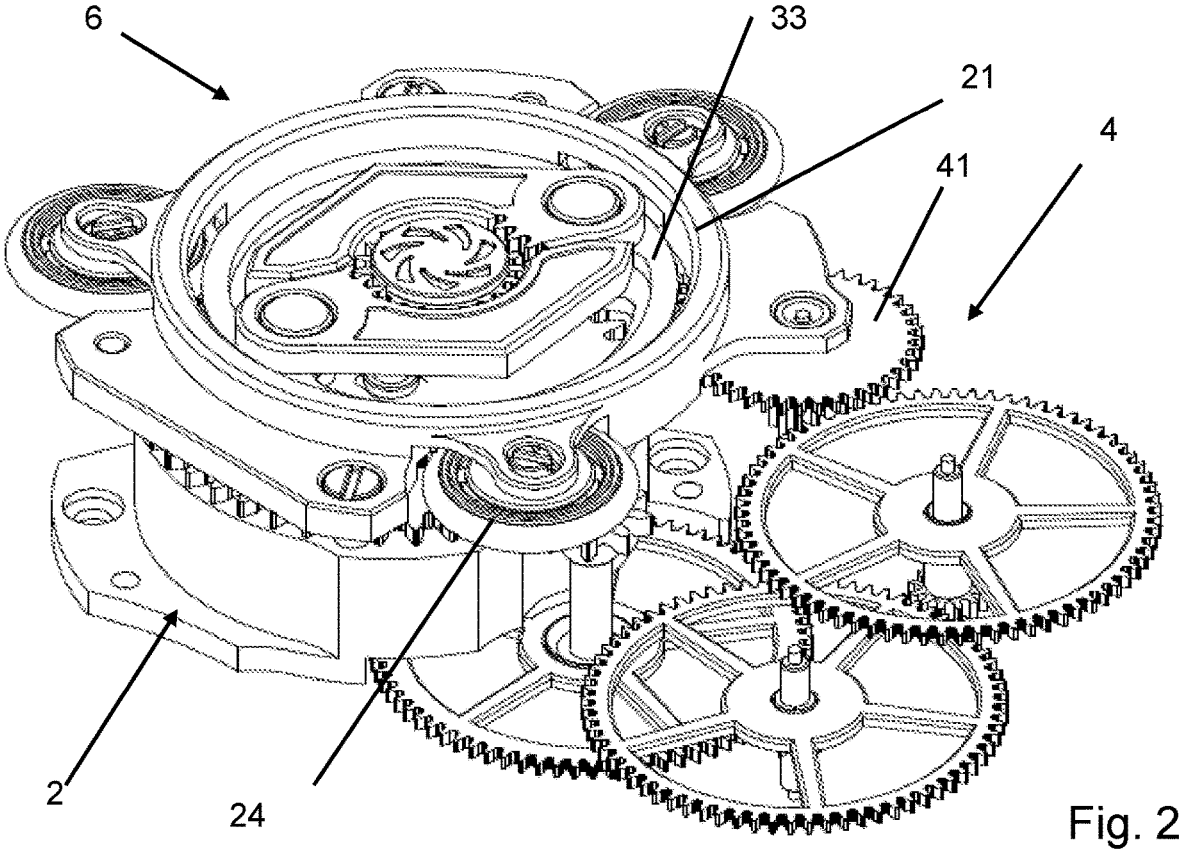
FIG. 2 a view of the regulator together with the components which drive it.
Figure 3:
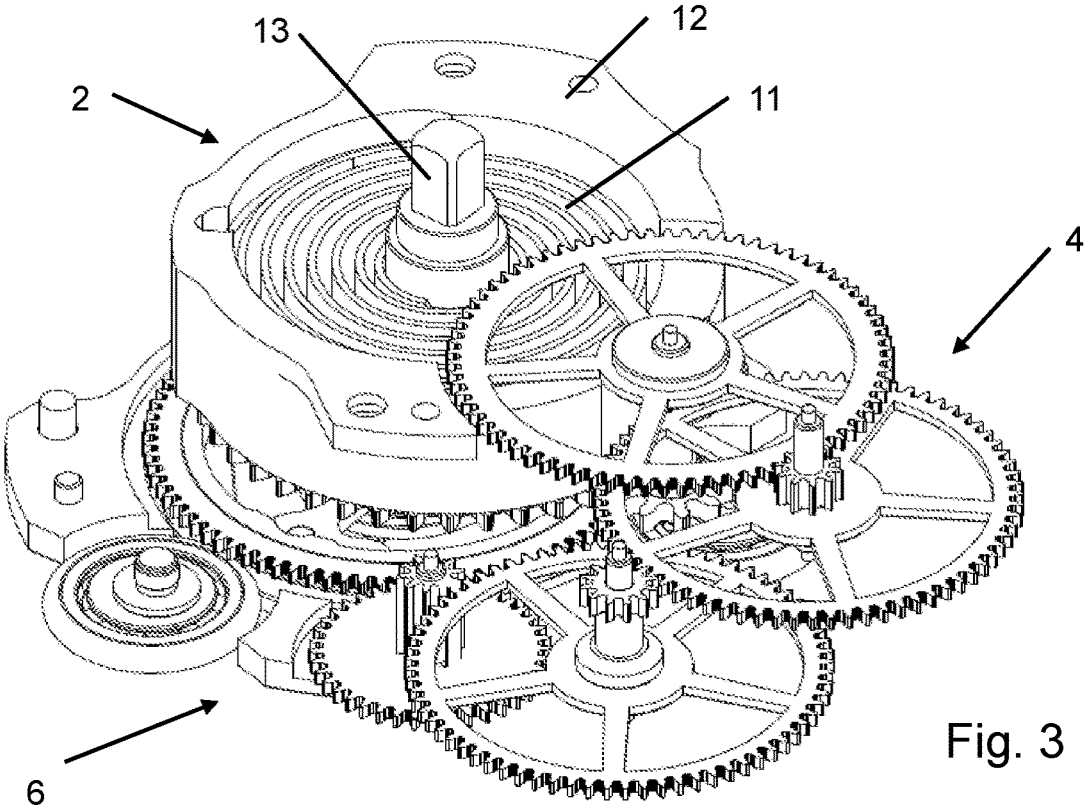
FIG. 3 a view of the regulator and the components according to FIG. 3 from another viewing direction.

FIGS. 2 and 3 show a regulator 6 together with the components the drive it, with an energy store and parts of the gear 4. The energy store includes a barrel 12 with a flat spiral spring 11; in FIG. 3 one can also see the winding stem 13.

FIGS. 4 to 7 show the regulator 6 together with the gearwheel 41 of the gear that drives it in a direct manner. The regulator includes a base 21 with an annular portion 22 which defines a rotationally cylindrical inner surface 23. Furthermore, several screw holes 24 for the fastening on an element which is fixed with regard to the housing, for example a movement plate are present on the base. Ball bearings 25 are attached in a stationary manner relative to the base via bearing pins 26. Each ball bearing includes an outer ring 27 and an inner element, specifically an inner ring 28, wherein the outer ring 27 can rotate with a low friction relative to the inner ring on account of the balls (roller bodies) 29 that are arranged therebetween. The rotary wheel 31 is rotatably mounted relative to the base 21 by the ball bearings 25.

Figure 5:
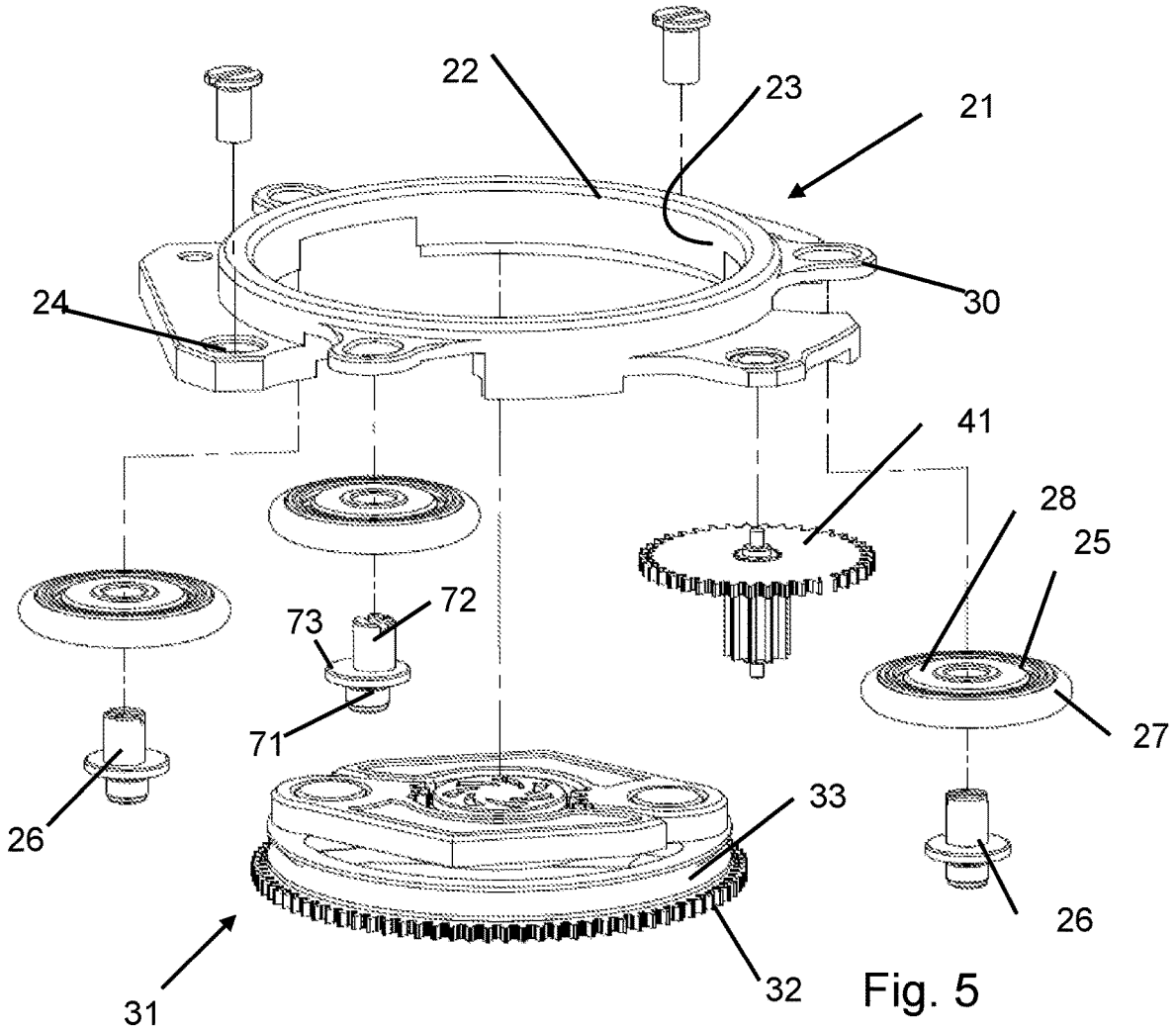
FIG. 5 an exploded representation of the components which are shown in FIG. 4.
Figure 6:
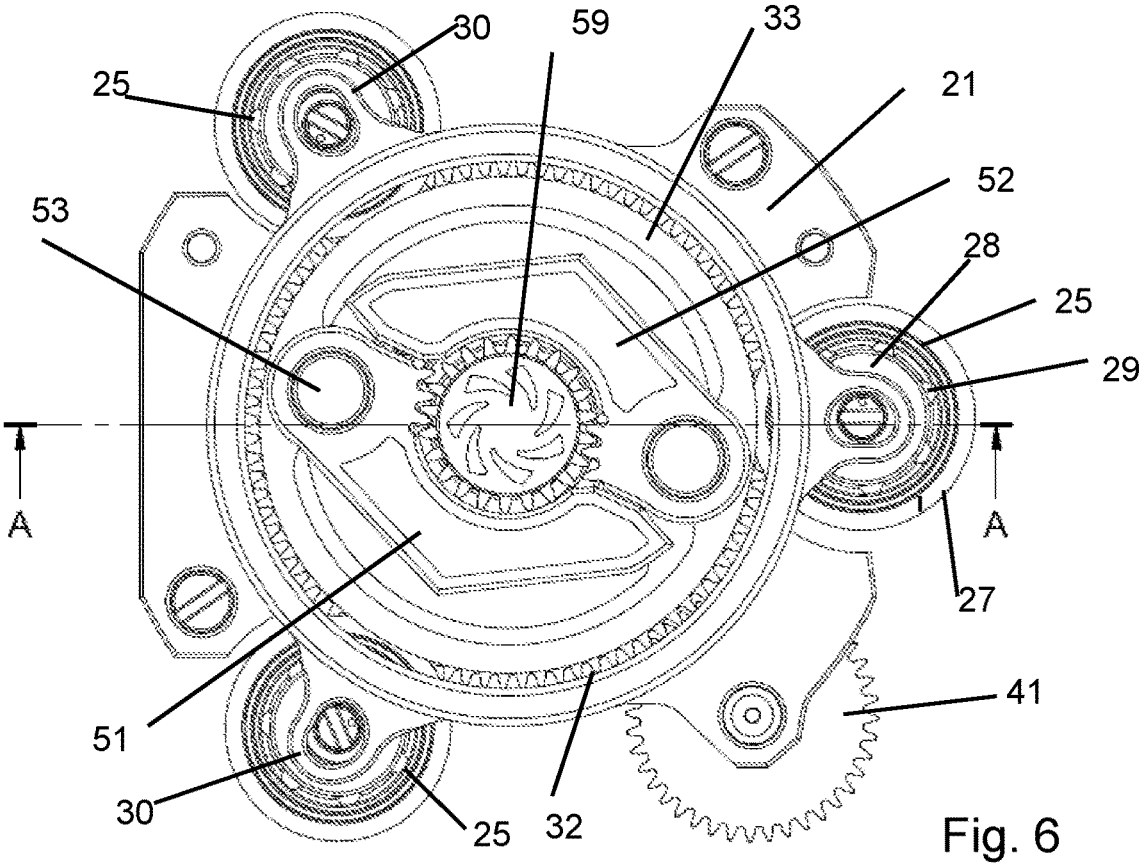
FIG. 6 a front view of the regulator with the gearwheel.

The bearing pin 26 includes a first pin portion 71 that, in FIG. 5, lies at the bottom and a second pin portion 72 that, in FIG. 5, lies at the top, with position plate 73 therebetween. The first pin portion has a position that is fixed with regard to the housing, and is mounted, for example, by way of a movement plate (not drawn). The second pin portion is attached eccentrically relative to the first pin portion and carries the respective ball bearing. By way of rotating the bearing pin, the position of the associated ball bearing can therefore be finely adjusted relative to the rotary wheel, for which a screwdriver slot can optionally be present as represented. The eyelets 30 (elongate holes) in the base 21, through which holes the second pin portion projects provides an adequate play for this purpose.

Figure 8:
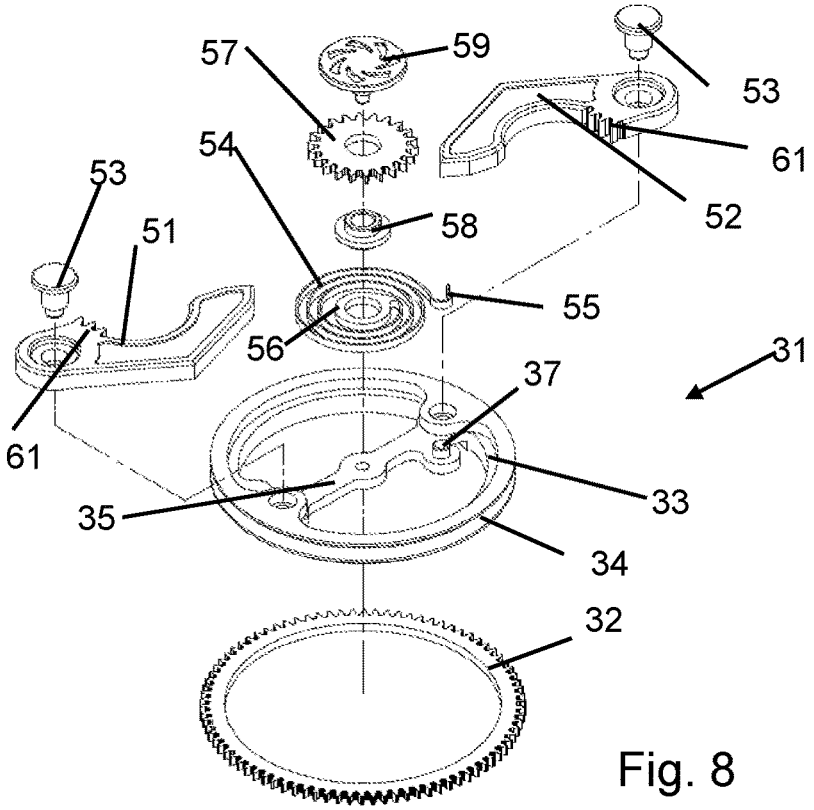
FIG. 8 an exploded representation of components of the regulator, specifically of the rotary wheel with the elements which are attached thereto.

FIG. 8 shows the construction of the rotary wheel 31 and the components which are present on it. The rotary wheel includes a toothed ring 32 and a bearing ring 33 that is fastened thereto. The bearing ring 33 includes an outer surface 34, which is provided with a groove and serves as a running surface. The radially outermost portion of the outer rings 27 of the ball bearings can engage into the groove of the running surface, in order to thus fix the position of the bearing ring and herein permits its low-friction rotation about its axis. The rotary wheel is thus laterally, i.e., floatingly mounted by the three ball bearings 25.

Figure 7:
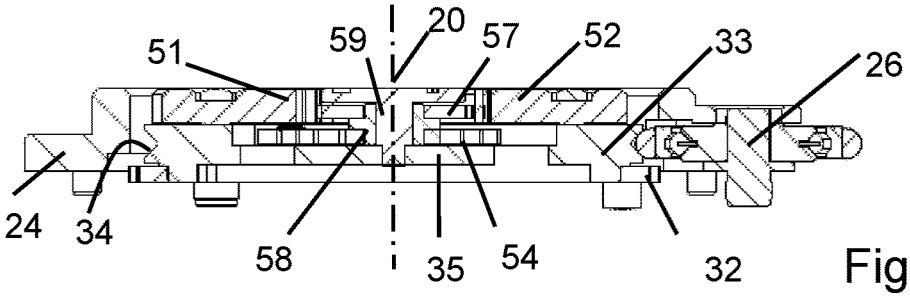
FIG. 7 the regulator sectioned along the plane A-A in FIG. 6.
Figure 9:
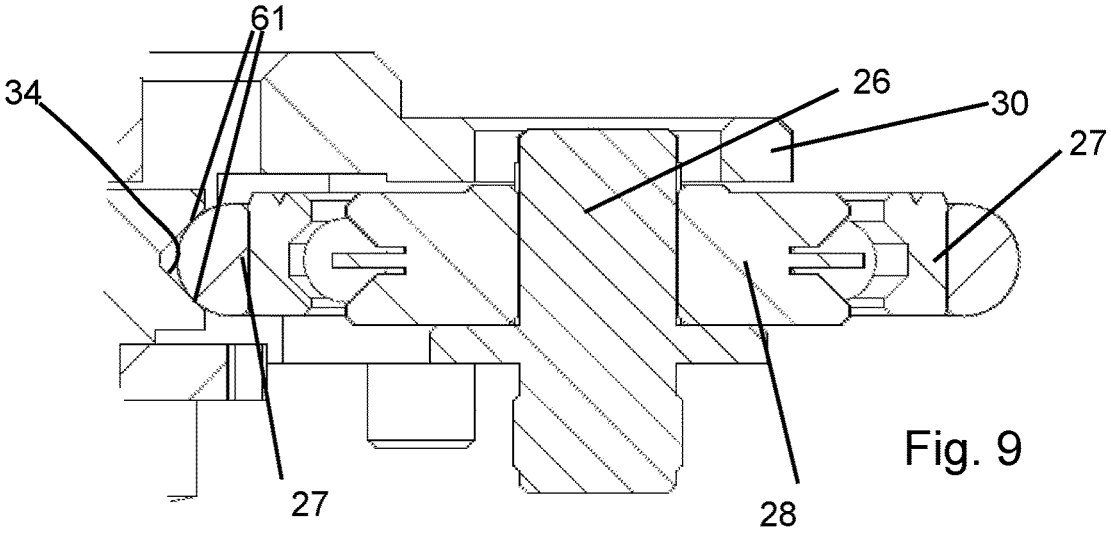
FIG. 9 a detail of FIG. 7.

FIG. 9 shows a detail of FIG. 7. One can see that the outer surface 34 is designed in a roughly V-shaped manner in cross section. In the present example, on account of the roughly V-shaped design of the groove that forms the running surface and the convex shape of the outer rings 27, there are only two contact points 61 per ball bearing, by way of which the resistance is minimised.

As an alternative to a groove, the outer surface of the bearing ring could also include a projection that engages into a corresponding groove of the outer rings of the ball bearings.

The outer surface can be coated with a low-wearing material that minimises the rolling friction, for example diamond like carbon (DLC). Otherwise, the applied materials can be metals or composite materials, in particular special plastics, or also ceramics, which per se are considered as being suitable for the described purpose, for example high-quality steels, titanium alloys etc.

Furthermore, a web 35, which is particularly well visible in FIG. 8, is fastened or present on the bearing ring 33. Furthermore, a first and a second mass element 51 and 52 are attached to the rotary wheel. The mass elements 51, 52 are pivotably fastened to the bearing ring 33 each via a fastening pin 53 (a fastening to the web or possibly to the toothed ring 32 would alternatively also be conceivable).

Figure 4:
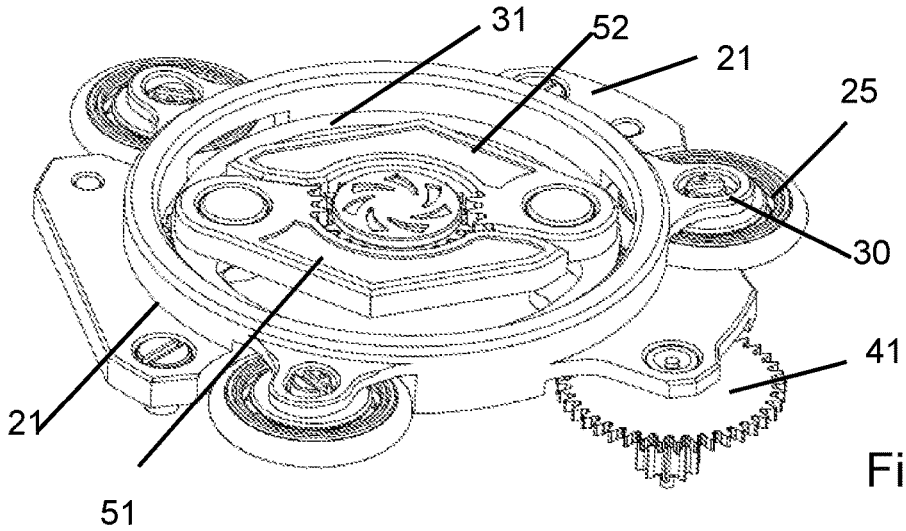
FIG. 4 the regulator which is also visible in FIGS. 2 and 3, only with the gearwheel which directly drives it.

The regulator moreover includes a restoring mechanism, which brings the mass elements in the basic state into the position that is represented in FIG. 4 and which opposes the centrifugal force with the mentioned spring force. This restoring mechanism includes a spiral spring 54 as well as a restoring gearwheel 57. The restoring gearwheel 57 is connected in a rotationally fixed manner to an inner ring 56 of the spiral spring 54 by way of a connection element 58. The inner ring 56, the connection element 58 and the restoring gearwheel 57 are commonly mounted on the web 35 in a rotatable manner, for which a central pin 59 serves. The mass elements each include a toothing 61 that engages into the teeth of the restoring gearwheel 57. A deflection of the mass elements to the outside effects a rotation of the restoring gearwheel 57. Since an outer-side coupling structure 55 of the spiral spring is suspended in a spring pin 37 of the web 35, and since the restoring cog is coupled to the inner ring 56 of the spiral spring in a rotationally fixed manner, this is effected counter to the spring force of the spiral spring 54.

On account of this design, only a single spring, here the spiral spring 54 is sufficient to simultaneously exert the necessary restoring force upon both mass elements 51, 52. Furthermore, the two mass elements are always deflected synchronously. In contrast to a design each with one spring per mass element, it is therefore not possible for one mass element to be deflected out further than the other.

The same effect can also be achieved if the spiral spring were to be fastened to the bearing ring or web at the inner side in a rotationally fixed manner and were to engage at the outer side on one of the mass elements and the mass elements were to be coupled via a freely rotatably cog.

The invention claimed is:

1. A regulator for a striking mechanism for a mechanical watch, the regulator comprising a base equipped to be assembled in a fixed manner with regard to the housing, and a rotary wheel, wherein the rotary wheel is rotatably mounted relative to the base and carries at least two mass elements, the mass elements being deflectable, by a centrifugal force, radially outwards counter to a spring force upon a rotation of the rotary, so as to regulate a rotation speed of the rotary wheel, the regulator further comprising at least three bearing elements attached to the base, said bearing elements engaging peripherally on the rotary wheel in order to mount the rotatory wheel relative to the base.

2. The regulator according to claim 1, wherein the bearing elements are ball bearings.

3. The regulator according to claim 1, wherein the rotary wheel comprises a radially outer outside surface serving as a running surface for the bearing elements.

4. The regulator according to claim 3, wherein the outer surface forms a groove into which an outer ring of the bearing elements engages.

5. The regulator according to claim 1, wherein the mass elements are coupled onto one another so that they can only be deflected together.

6. The regulator according to claim 5, comprising a single spring element which commonly exerts the spring force which counteracts the centrifugal force, upon both mass elements.

7. The regulator according to claim 6, wherein the spring element is a spiral spring.

8. The regulator according to claim 5, comprising a restoring gearwheel being rotatably fastened to the rotary wheel, the restoring gearwheel being toothed with the mass elements and being rotatable relative to the rotary wheel by way of a deflection of the mass elements.

9. The regulator according to claim 1, wherein at least one of the bearing elements is mounted by a bearing portion whose position relative to the base can be set at least in the radial direction for the purpose of adjustment.

10. The regulator according to claim 9, wherein the bearing portion is an eccentrically attached pin portion of a bearing pin.

11. The regulator according to claim 1, wherein the base comprises a rotationally cylindrical inner surface arranged such that the mass elements on account of the centrifugal force can be deflected to such an extent that they contact the inner surface.

12. The regulator according to claim 1, wherein the rotary wheel comprises a toothed ring with a toothing, into which a gearwheel of a gear can engage, as well as a bearing ring, and wherein the bearing elements engage on the bearing ring of the rotary wheel.

13. A striking mechanism for a mechanical watch, comprising a striking device, a drive and the regulator according to claim 1.

14. The striking mechanism according to claim 13, being a repetition striking mechanism and comprising an actuation element via which a bell strike can be manually activated.

15. The striking mechanism of claim 14, wherein the repetition striking mechanism is a minute repeater.

16. A wristwatch comprising the striking mechanism according to claim 13.

* * * * *